US006764560B1

(12) United States Patent
Mogilevsky

(10) Patent No.: US 6,764,560 B1
(45) Date of Patent: Jul. 20, 2004

(54) METHOD OF FORMING CAST ALLOYS HAVING HIGH STRENGTH AND PLASTICITY

(76) Inventor: Mikhail A. Mogilevsky, 9804 NE. 34th Pl., Bellevue, WA (US) 98004

( * ) Notice: Subject to any disclaimer, the term of this patent is extended or adjusted under 35 U.S.C. 154(b) by 34 days.

(21) Appl. No.: 09/695,180

(22) Filed: Oct. 24, 2000

Related U.S. Application Data

(60) Provisional application No. 60/162,565, filed on Oct. 29, 1999.

(51) Int. Cl.[7] ..... C21D 1/18
(52) U.S. Cl. ..... 148/543; 148/660
(58) Field of Search ..... 148/543, 660

(56) References Cited

U.S. PATENT DOCUMENTS 3,951,697 A 4/1976 Sherby et al.
4,448,613 A 5/1984 Sherby et al.
4,533,390 A 8/1985 Sherby et al.
4,769,214 A 9/1988 Sherby et al.
4,916,030 A * 4/1990 Christodoulou et al. .... 428/614
5,139,579 A * 8/1992 Kovacs et al. ..... 148/322
5,141,574 A 8/1992 Takahashi et al.
5,288,342 A 2/1994 Job
5,413,647 A * 5/1995 Ablett et al. ..... 148/539
5,445,685 A * 8/1995 Strum et al. ..... 148/324
5,545,685 A 8/1996 Davis et al.

OTHER PUBLICATIONS

Cheng, S.C. et al., "Superplastic Behavior of Two–Phase Titanium Aluminides," *Metallurgical Transactions A*, vol. 23A, pp. 1509–1513, May 1992.
Wadsworth, J. et al., "On the Bulat (Damascus Steels)," *The Journal of Japanese Society of Metallurgy*, pp. 7–23, 1980.

* cited by examiner

*Primary Examiner*—Deborah Yee
(74) *Attorney, Agent, or Firm*—Christensen O'Connor Johnson Kindness PLLC

(57) ABSTRACT

The present invention provides cast high-carbon steel having high strength and plasticity and a method for its formation. In the method, forming during cooling from the melting point through temperature control results in a structure having small size cementite grains supported in a plastic matrix. Alloys other than high-carbon steel, including nickel, titanium, zirconium, and aluminum, can also be produced by the process.

16 Claims, 9 Drawing Sheets

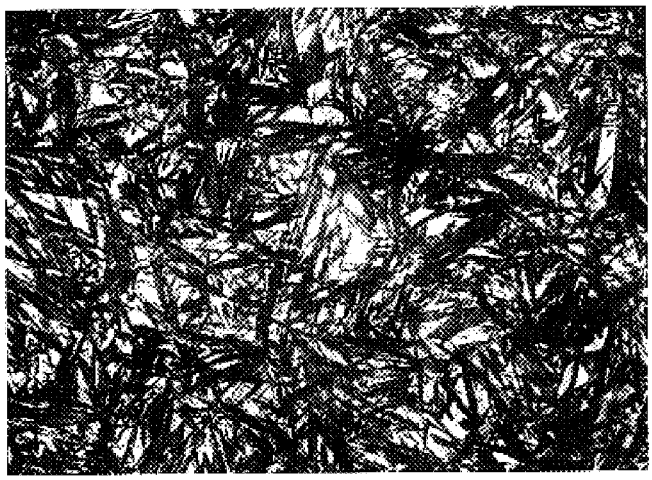
*Fig.13A.*
*Fig.13B.*
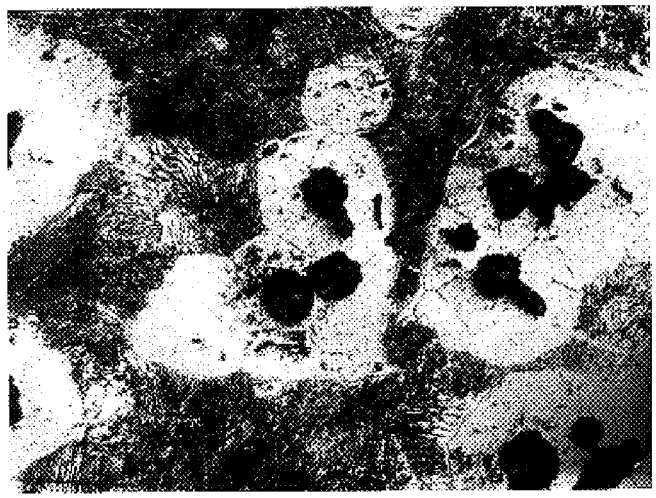
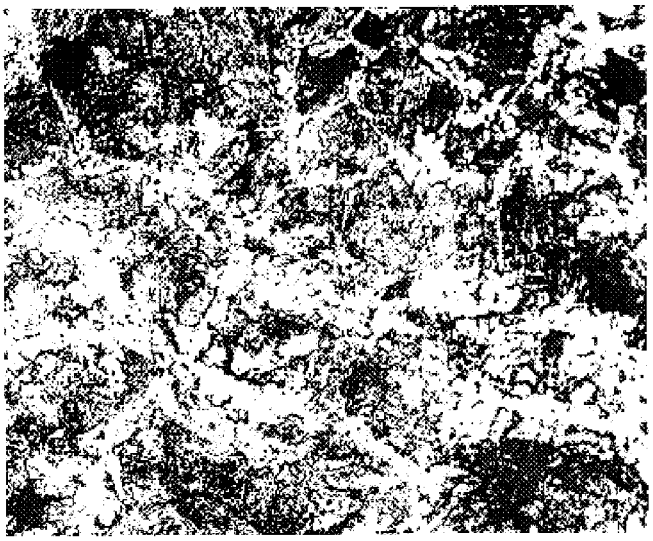
*Fig.13C.*

METHOD OF FORMING CAST ALLOYS HAVING HIGH STRENGTH AND PLASTICITY

CROSS-REFERENCE TO RELATED APPLICATION

This application claims the benefit of U.S. provisional application No. 60/162,565, filed Oct. 29, 1999.

FIELD OF THE INVENTION

The present invention relates to cast alloys having high strength and plasticity, and more specially, to cast high-carbon alloys.

BACKGROUND OF THE INVENTION

The cementite $Fe_3C$ produces effective hardening of steels both being part of pearlite and as a separate phase in high-carbon compositions. Cast high-carbon steel includes the cementite phase in a form of rough platelets and layers along the grain boundaries. Such steel is hard but brittle. Certain high temperature treatments can cause cementite to coagulate to provide cementite having a spherical structure referred to as grain pearlite or grain cementite.

Annealing processes can produce steel having grain cementite structure. Hard and brittle high-carbon steel having a carbon content greater than about 0.8% can be transformed into the plastic state by heat treatment. Annealing high-carbon steel at high temperature without air access for three days caused cementite platelets to coagulate into a grain cementite structure. Anosov, P. P., O bulatach, Gorny Journal, kn. II:157 (1841). However, excessive annealing temperature results in carbon separation and precipitation (i.e., graphitization). More contemporary processing guides recommend either long annealing at a temperature just below the austenite-ferrite $A_1$ phase transition or an annealing process with the temperature oscillation temperature near the $A_1$ phase transition. Long, high-temperature annealing produces large cementite particles characterized as particle diameter greater than about 10 $\mu$m. The strength of such steels is low.

More than two millenniums ago, craftsmen of India and Persia discovered a method for developing Damascus steel, a high-carbon steel that is extremely strong, non-brittle, and having a characteristic surface pattern. Russian metallurgist P. P. Anosov studied Damascus steel and, through systematic investigation, developed a process for the production of Russian bulat (Damascus) steel at the Zlatoust plant (Ural). Anosov's research determined that Damascus steel is high-carbon steel that has been subjected to an intensive forging at high temperature. Microscopic investigation was used for the first time in this research for analysis of technological process in steels. Anosov noted that in the highest quality forged bulats "broken lines become shorter and transform into points". The formation of small cementite spherical particles was later confirmed later in detailed microstructural investigations of Damascus steel. See, e.g., Belaiew, N. T., Damascene Steel, Journal of Iron and Steel Institute, Vol. 47:417 (1921); Sherby, O. D., Ultrahigh-carbon Steels, Journal of Metals, 50–55 (June 1985); and Verhoeven, J. D., Damascus Steel, Part III: The Wadsworth-Sherby Mechanism, Materials Characterization, Vol. 24:205–227 (1990). The microstructure of a blade made from Damascus steel is illustrated in FIG. 5. The microstructure includes cementite particles having diameters from about 4 to about 20 $\mu$m, which were produced during forging from original thick layers of cementite. The cutting edge of a Damascus sword is a saw-like structure with sharpened particles supported in a plastic matrix. Small, submicron-size cementite particles between these rows were produced during the thermomechanical treatment from the original thin interlayers of cementite in pearlite. These submicron cementite particles are responsible for high strength of Damascus steel, which is an example of a composite material having small hard particles supported in a soft plastic matrix. The analysis of diffusion effects across the decarburization zone in a typical Damascus sword permitted to estimate the forging temperature in the range 740–760° C. and a lower limit of forging time of around 4 hour. See, Verhoeven 1990.

Fundamental scientific research on the development of high-carbon steel with the uniform submicron-size cementite structure was performed by Sherby in the 1970s and 1980s. The Sherby method for forming high-carbon steel closely resembles the method of Damascus craftsmen. Both methods include numerous cycles of intensive high temperature deformation and annealing. While Damascus steel is formed by forging, the Sherby method utilizes rolling as the deformation means.

U.S. Pat. No. 3,951,697, issued to Sherby, describes an ultra high-carbon steel having a carbon in excess of about 1.0% and an iron grain matrix with uniformly dispersed cementite. The iron grain in the steel being stabilized in a predominantly equiaxed configuration having an average grain size no greater than about 10 microns, and the cementite being in predominantly spheroidized form in a temperature range of 723° C. to 900° C. Sherby's method for forming such steel includes the steps of heat treating at least 500° C. and mechanically working the heat-treated steel under sufficient strain deformation to form an iron grain matrix with uniformly dispersed cementite.

The Sherby patent describes a representative thermal mechanical process for developing the high-carbon steel with extremely small size both of iron grains and cementite particles:

> A casting of the 1.3%C steel was heated to 1130° C. for 60 minutes and then was rolled continuously, in fifteen passes, at 15% per pass, to a true strain to 2.0. Since the original casting cooled during rolling it experienced deformation in gamma range as well as gamma plus cementite range. When a temperature of 565° C. was reached it was rolled isothermally in this ferrite plus cementite range to an additional true strain of 0.8 (again, at 10% per pass). The microstructure of the warm worked steel reveals a fine spheroidized structure with ferrite grains in the order of one micron and less. The room temperature properties of the material were as follows: (1)the Rockwell "C" hardness of the plate was 46, and (2) tensile tests revealed a yield strength of 195 ksi, an ultimate tensile strength of 215 ksi and tensile elongation of 4.2%. The high temperature properties reveal this material to be superplastic with 480% elongation to fracture at 650° C. when deformed at a strain rate one percent per minute.

Damascus steel generally has the structure described by Sherby. The relationship between the Sherby method and the method for producing the Damascus steel has been described. See, e.g., Wadsworth. (1980) and Sherby (1985).

Several subsequent patents related to further improvements of the superplastic propeties of high-carbon steels by means of the optimization of their composition and regimes of the thermal mechanical processing. These patents include U.S. Pat. No. 4,448,613, entitled "Divorced eutectoid transformation process and product of ultrahigh-carbon steels", which describes additional thermal treatments, with and without deformation of high-carbon steels with Cr, Mn and Si for improving the structure; U.S. Pat. No. 4,533,390, entitled "Ultra high-carbon steel alloy and processing thereof", which describes increasing by means of higher concentration of Si and Cr the eutectoid temperature so that superplastic processing may proceed at high strain rates and low stress levels at elevated temperatures; and U.S. Pat. No. 5,445,685, entitled "Transformation process for production of ultrahigh-carbon steels and new alloys", which describes increasing the temperature for superplastic deformation by means of higher concentration of Al, Cr and Mn and cooling the steels from temperature of dissolving the major part of carbides ($A_t$+50° C.) with the controlled cooling rate to obtain a steel having substantially spheroidized cementite.

Despite the advancements made in developing processes for forming high-carbon steel, deficiencies in these processes remain. Important negative effects of the long high-temperature heat treatment in all above mentioned methods include the tendency of the grain size to grow and the coagulation of carbides. These effects may decrease catastrophically the strength of materials. Although, the best mechanical characteristics of high-carbon steels may be achieved when these negative effects are overcome at least partially by means of rather high concentration of carbide-forming additives and the demand to perform the intensive high temperature deformation in a narrow temperature window, both of these approaches increase the cost of materials. Accordingly, there exists a need for methods for forming high-carbon steel having high strength and plasticity. The present invention seeks to fulfill this need and provide further related advantages.

SUMMARY OF THE INVENTION

In one aspect the present invention provides cast high-carbon steel having high strength and plasticity and a method for its formation. In accordance with the method, castings from high-carbon steels are formed by a casting process through temperature control that provides the formation of metal in high-strength and plastic condition. The microstructure of the high-carbon steel formed in accordance with the invention is characterized as having a small grain size and microspherical form of carbide particles dispersed substantially throughout the alloy matrix. Articles formed by the method possess high strength and high plasticity. The high-carbon steel formed by the method has a structure similar to the structure of Damascus steel. However, unlike Damascus steel, which is formed by repetitive forging deformation (e.g., hammering), the method of the invention does not include cycles of high temperature deformation and annealing.

In the method of the invention, forming during cooling from the melting point through temperature control results in a structure without rough cementite plates that are characteristically formed by conventional processes. Instead, the method provides small size cementite grains supported in a plastic matrix, a structure analogous to Damascus steel.

In another aspect, the invention provides alloys other than high-carbon steel produced by the process of this invention. Alloys may include other matrix elements, for example, nickel, titanium, zirconium, aluminum, among others. The composition of an alloy and optimal temperature control of the cooling from the liquid state can be selected for producing a strengthening phase in the form of small size spherical particles. Principal additives in alloys can produce carbides, borides, nitrides, oxides and/or intermetallides of appropriate size and in appropriate quantity.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein:

FIGS. 13A–13C are photomicrographs of microstructures of the steel having 1.8%C and cooled from 1140° C. with different velocities: FIG. 13A, cooling with a furnace, illustrates matrix from ferrite and low-carbon pearlite grains with large, about 20 $\mu$m, graphite particles; FIG. 13B, quenching into the liquid Wood alloy, illustrates uniform distribution of 20–40 $\mu$m-long cementite platelets at the central part of the sample; and FIG. 13C, cooling in air to 700–750° C. and 1 hour annealing, illustrates chains of rough rounded cementite particles at the grain boundaries, low-carbon pearlite structure inside grains.

DETAILED DESCRIPTION OF THE PREFERRED EMBODIMENT

Figure 1:
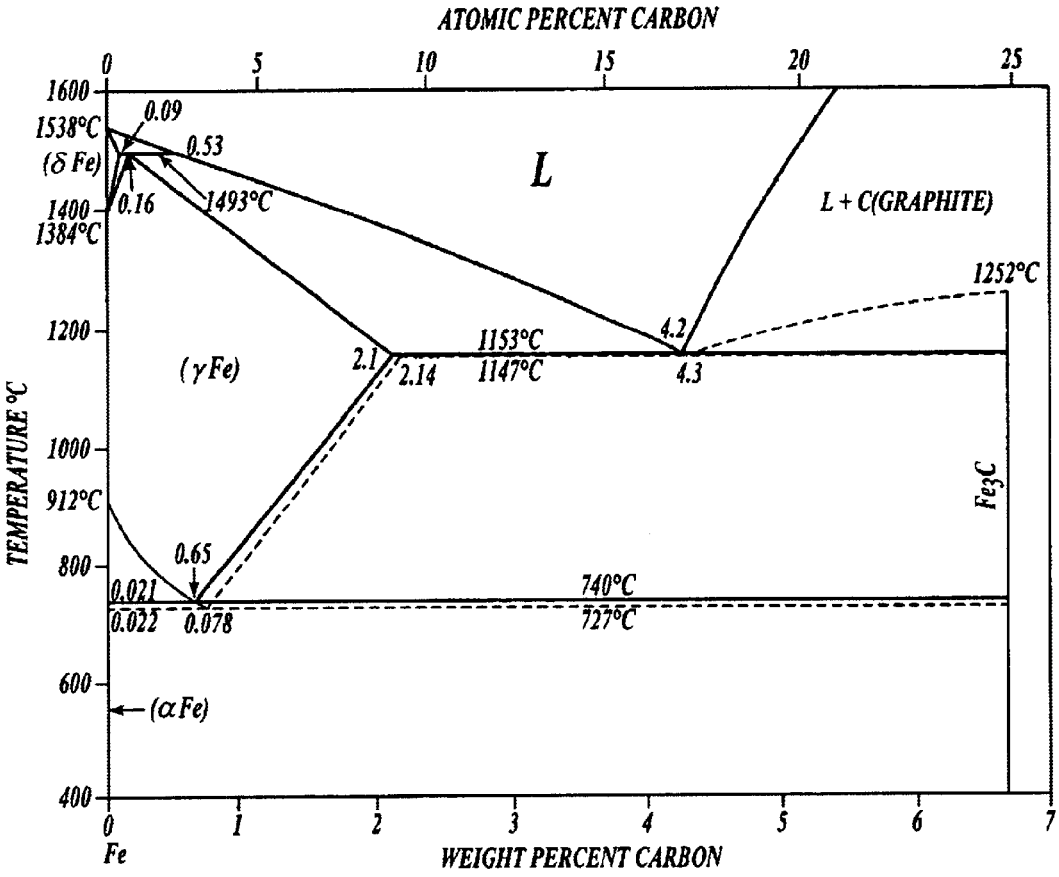
FIG. 1 is the phase diagram for the Fe—C system.
Figure 2:
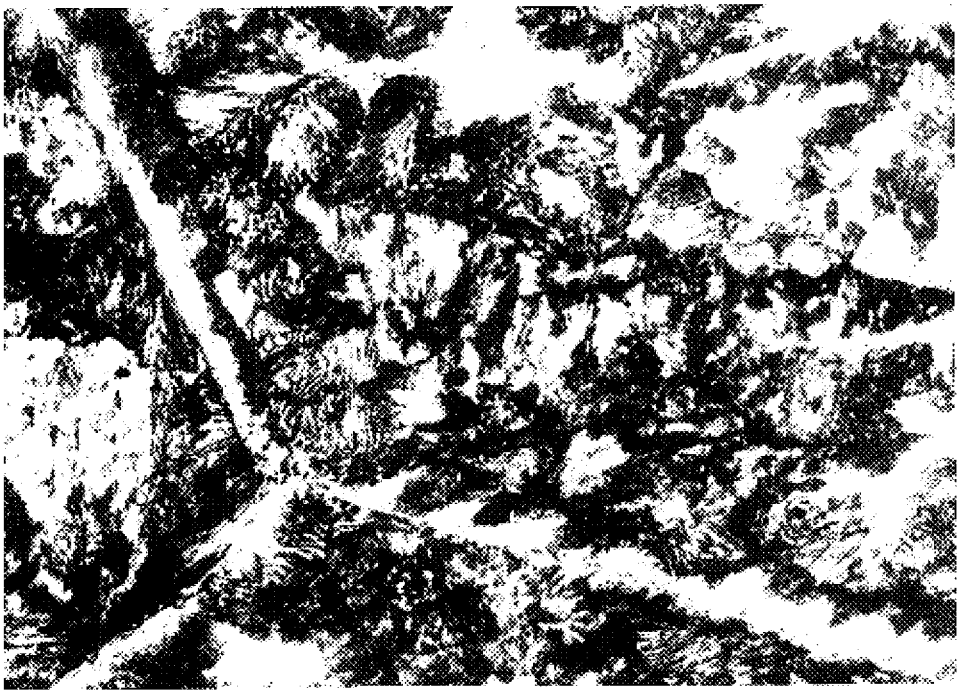
FIG. 2 is a photomicrograph (500×) of the microstructure of a steel with 1.8% C, 0.20% Cu and 0.5% Si after casting and slow cooling in a standard sand form, illustrating thick cementite layers at the grain boundaries and pearlite structure.

Generally, phase diagrams illustrate solubility changes that occur for multicomponent systems as a function of temperature and changes in phases and structure that depend on cooling rate. A phase diagram for the Fe—C system is shown in FIG. 1.

High-carbon alloys with the carbon content more than about 1% and up to about 3% are referred to as cast iron. Cast iron has a melting point of about 1150° C. Upon very slow cooling from its melting point graphite (i.e., the thermodynamic stable equilibrium phase) is precipitated. The precipitated graphite is referred to as graphite globules, which have a size greater than about 5 $\mu$m. With conventional cooling cementite $Fe_3C$ is precipitated in the form of rough interlayers at grain boundaries and thick platelets. However, as noted above, certain thermomechanical treatments can result in the formation of cementite in the small grain form. These thermomechanical treatments include, for example, several cycles of the intensive hot deformation for disintegration of rough cementite layers and long high temperature annealing for coagulation. These methods can produce high strength and high plasticity steel through high temperature hammering (i.e., Damascus steel) and through high temperature rolling (i.e., the Sherby method).

The present invention provides a method for forming high-carbon, high strength and high plasticity steel through a temperature controlled process in which cooling rate provides for cementite precipitation in small grain form during cooling from its melting point.

In the Fe—C system, for slow cooling from the melting point, the fall in solubility of carbon in the metal with decreasing temperature results in the nucleation of thermodynamically equilibrium phase, spherical graphite, and its subsequent growth to large diameter.

For rapid cooling from the melting point, a metastable phase, cementite ($Fe_3C$), is produced in the form of rough platelets and thick interlayers at grain boundaries. Propagation of the cementite platelet along some crystallographic plane provides for conditions sufficient for the diffusion of carbon atoms to the platelet at smaller distances compared to diffusion for formation of a spherical particle of the same volume.

In the method of the present invention, cooling with a rate intermediate the slow and rapid cooling regimes noted above provides for the development of the metastable phase cementite in small grain form.

In one aspect, the present invention provides a method for forming steel having from about 0.8 to about 2.3 percent by weightcarbon having high strength and high plasticity. In one embodiment, the method includes casting a liquid high-carbon steel into a form to provide cast high-carbon steel (i.e., the melt) and then cooling the cast high-carbon steel at a rate to provide a steel having grain cementite particles with a diameter in the range from about 0.1 to about 5.0 $\mu$m. In the method, the cooling rate is greater than the rate resulting in the formation of graphite globules from the alloy, and wherein the cooling rate is less than the rate resulting in the formation of cementite platelets.

As used herein the term "cooling rate" refers to the decrease in temperature of the cast metal over time. The cooling rate can be achieved by temperature control of the cast metal through, for example, the temperature control of the form. Generally, cooling rate can be controlled by the amount of heat removed from the cast metal (e.g., through the form) over time. The details of heat exchange are well known to those in the art. For example, the heat flux (in $Wt/m^2$units) into a thick form from a large plate can be estimated with the formula:

$$q=0.56(\lambda_f\rho_f c_f)^{1/2}(T_o-T_f))t^{-1/2} \quad (1)$$

where q is the heat flux, $\lambda_f$ is the heat conductivity of the form material, $\rho_f$ is the density of the form material, $c_f$ is the heat capacity of the form material, $T_o$ is the temperature of the melt, $T_f$ is the initial temperature of the form, and t is time. Thus, for any alloy, the cooling rate can be controlled by varying the parameters of the form noted above and other parameters including, for example, the form's initial temperature, and the mass of the casting (i.e., melt).

In another embodiment, the invention provides a method wherein the cast high-carbon steel is cooled at a velocity to provide thin platelet cementite (platelet thickness less than about 1 $\mu$m) and then annealed at a temperature in the range from about 700 to about 800° C. to provide small grain cementite.

Steel formed in accordance with the method has a strength from about 120 to about 250 $kg/mm^2$ and plasticity of about 10%. The steel formed in accordance with the invention includes from about 10 to 60 volume percent grain cementite and, preferably, from about 20 to about 40 volume percent grain cementite.

In the method, alloy additives can be included to stabilize grain cementite, decrease austenite-ferrite grain size, and to promote carbide formation. The influence of Cr, Mo and V, which develop carbides in different crystallographic systems, on spheroidization in steels with. 0.8% C is known. Nakano, T., Effects of Chromium, Molybdenum and Vanadium on Spheroidization of Carbides in 0.8% Carbon Steel, Transactions of the Iron and Steel Institute of Japan, 17: 110–115 (1977). The studied elements form carbides of different crystallographic structure: $(FeCr)_3C$, $Mo_2C$, and VC. The study concludes that carbide-forming additives that develop in the austenite phase carbides of the same type $M_3C$ as cementite $Fe_3C$ are preferred. It can be noted that any particle in liquid metal can become the center of crystallization at sufficiently high cooling rate.

Additives favorable for stabilization of cementite and decreasing of the ferrite grain size include metals such as Cr, Mo, Mn, Al, Si in relatively small concentrations (predominantly 1–2%). These materials can provide improved conditions for producing a structure with small grain size and microspherical cementite particles during the process of cooling from the liquid state.

The method of the invention can also be utilized with previously known high-carbon alloys with additives that favor the formation of small or ultra small grain size matrix and stabilize the carbide phase against of graphitization;

As noted above, the invention provides a method for cooling an alloy from the liquid state to produce a structure with an appropriate grain size and a uniform distribution of small strong particles (e.g., dispersion hardening particles). The methods provides for controlled coagulation of these strong particles.

The method for developing strong and non-brittle alloys with the structure of a classic composite type (i.e., hard particles in softer matrix) is based on two distinctive physical effects: (1) the precipitation of the second phase due to the decreasing the solubility of an additive with cooling from the melt; and (2) the precipitation of the second phase proceeding by two different mechanisms, namely, either through the formation of the platelet structure or through the formation of granular structure. The later mechanism is preferable from the point of view of less surface energy, that is producing more thermodynamically stable structure. However, this mechanism demands longer distance diffusion of additive atoms compared with the formation of a platelet structure. Thus, at the given concentration of nuclei there exist some critical cooling rate that divides the fields of realized processes. Increasing the concentration of nuclei of precipitation, achievable by introducing special additives, can increase the value of the critical cooling rate.

Hardening effect produced by the uniform distribution of small-size strong precipitates in softer matrix is referred to as "dispersion hardening". Dispersion hardening is a main principle of contemporary physical metallurgy. Meyers, M. A., Mechanical Metallurgy, Principals and applications, Prentice Hall, New Jersey (1984).

The method of the invention for developing a strong and plastic alloy in the Fe—C system with the structure of small size cementite through cooling rate control is applicable for developing analogous structures in other alloys. Due to the common operating principle, other types of alloys can be developed with structures characterized as having small size strengthening particles supported in a non-brittle matrix. Representative alloy types are described below.

1. Special Steels With Carbide-forming Additives

The method of the invention can provide special steels that include carbide-forming additives. Representative steels that include such additives are described below.

Figure 12:
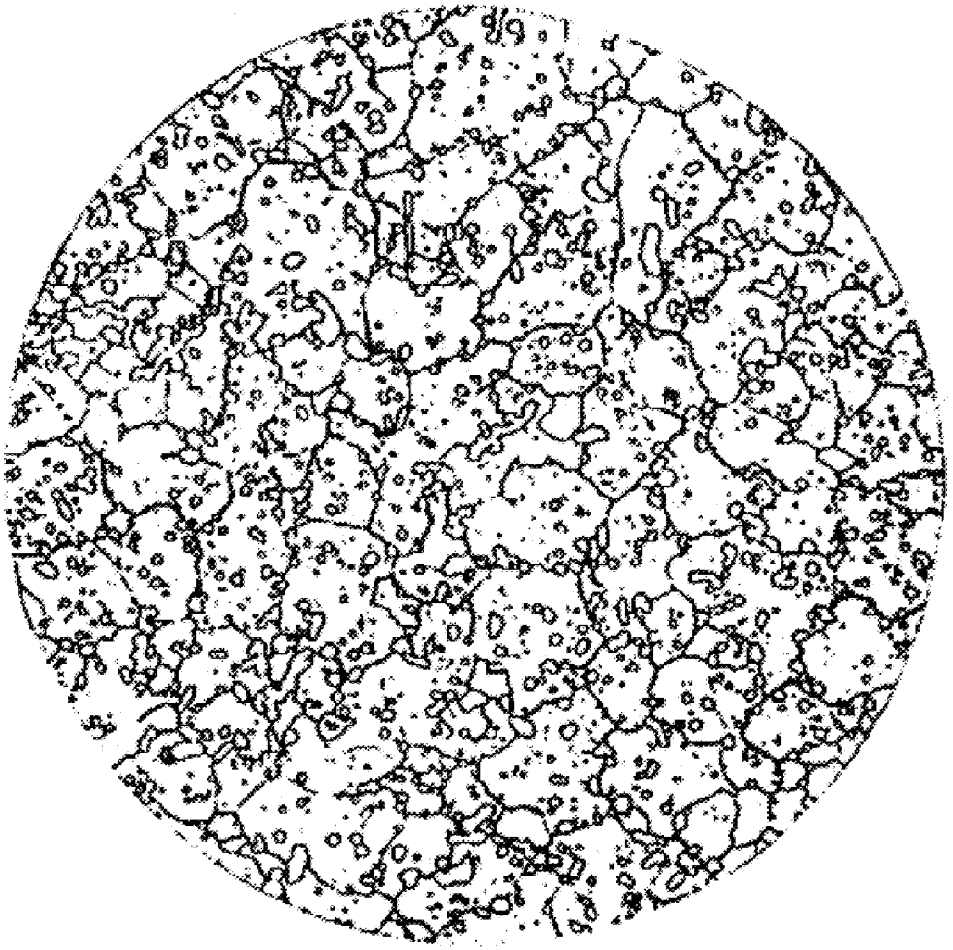
FIG. 12 is a photomicrograph (500×) of the microstructure of a steel having 0.70% C, 18.50% W, 3.75% Cr, 1.10% V, 0.25% Mn, 0.20% Si after a heat treatment.

FIG. 12 presents the microstructure of heat treated highly alloyed steel of the following composition 0.70% C, 18.50% W, 3.75% Cr, 1.10% V, 0.25% Mn, 0.20% Si which was widely used at least 50 years ago for high speed cutting. See, Teihart, E. J., Metallography and Heat Treatment of Steel, Vol. III, McGraw-Hill, 1944. Such a steel possesses high hardness $R_c$64 up to 600° C. and is plastic due to the formation of small size carbide structure both at the grain boundaries and inside grains.

The formation of submicron-size carbides in a medium-carbon steel with 6% W during annealing at 700° C. for 4 h. was shown in an electron microscopic study. See Electron Microscopy and Microanalysis of Crystalline Materials, ed. Belk, J. A., Appl. Sci. Publ., London (1979).

The mechanical characteristics of the Hadfield manganese steels, which are widely used during the century for producing cast details working in the hard conditions of impact abrasion, can be improved by the method of the invention. As was shown recently, mechanical characteristics of this popular material can be improved by means of decreasing the grain size and formation of the uniform distribution of coagulated small size carbides. Goldberg, A., Development of Ultrafine Microstructures and Superplasticity in Hadfield Manganese Steels, Mat. Sci. Eng., A150:187–194 (1992). The method of the invention enables decreasingthe grain size and provides for uniform distribution of carbides without additional high-temperature mechanical treatment. Accordingly, high-manganese steels formed by the method of the invention can be associated with the selection of additives for strengthening the grain boundaries and improving the matrix characteristics.

2. Nickel-based Alloys

Nickel-based alloys and superalloys are widely used for developing of turbine blades and structural applications. The composition of some typical nickel-based superalloys is presented below:

| | | | | | | | |
|---|---|---|---|---|---|---|---|
| Nimonic 80A | | 19.5% Cr | 1.4% Al | 2.2% Ti | 0.10% C | | |
| Nimonic 105 | 19.5% Co | 14.6% Cr | 4.7% Al | 1.2% Ti | | 5.0% Mo | 0.12% C |
| Mar - M246 | 10.0% Co | 9.0% Cr | 5.5% Al | 1.5% Ti | 0.05% Zr | 2.5% Mo | 10.0% W |
| | | | | | | 0.015% B | 0.15% C |

See, Winstone, M. R., Microstructure and Alloy Developments in Nickel-Based Superalloys in Microstructural Stability of Creep Resistant Alloys for High Temperature Plant Applications, Microstructure of High Temperature Material, No. 2, The Institute of Materials.

Figure 4:
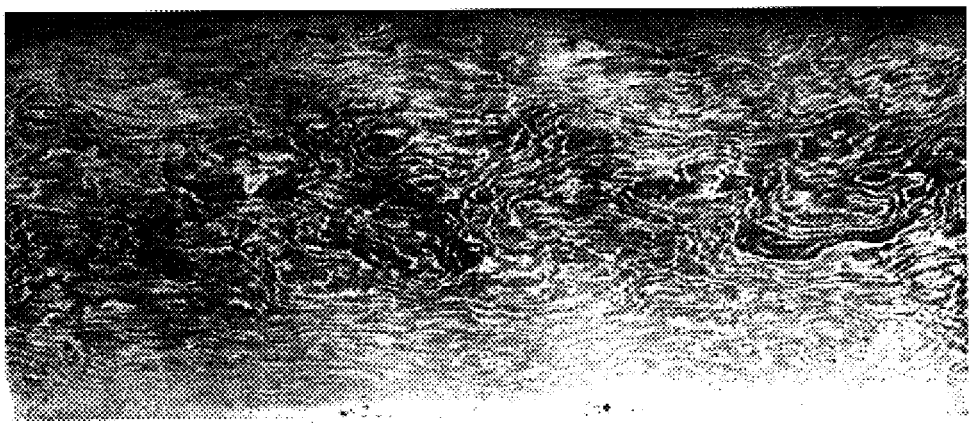
FIG. 4 is a photograph (1:1) of an etched surface of a Damascus blade.
Figure 5:
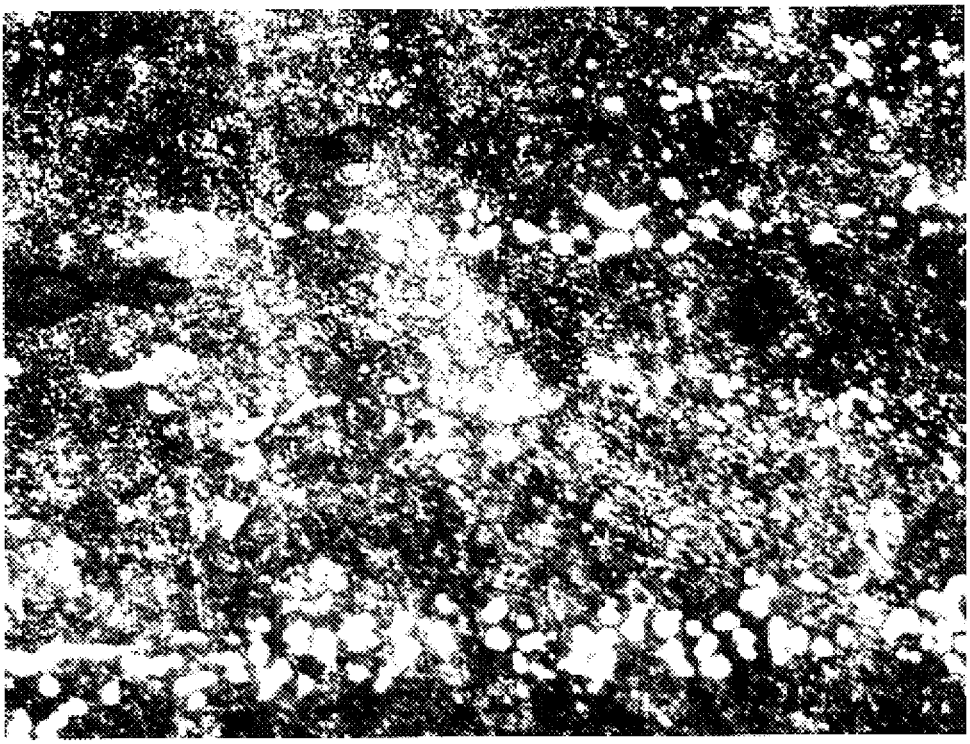
FIG. 5 is a photomicrograph (500×) of the microstructure of the Damascus blade shown in FIG. 4.
Figure 6:
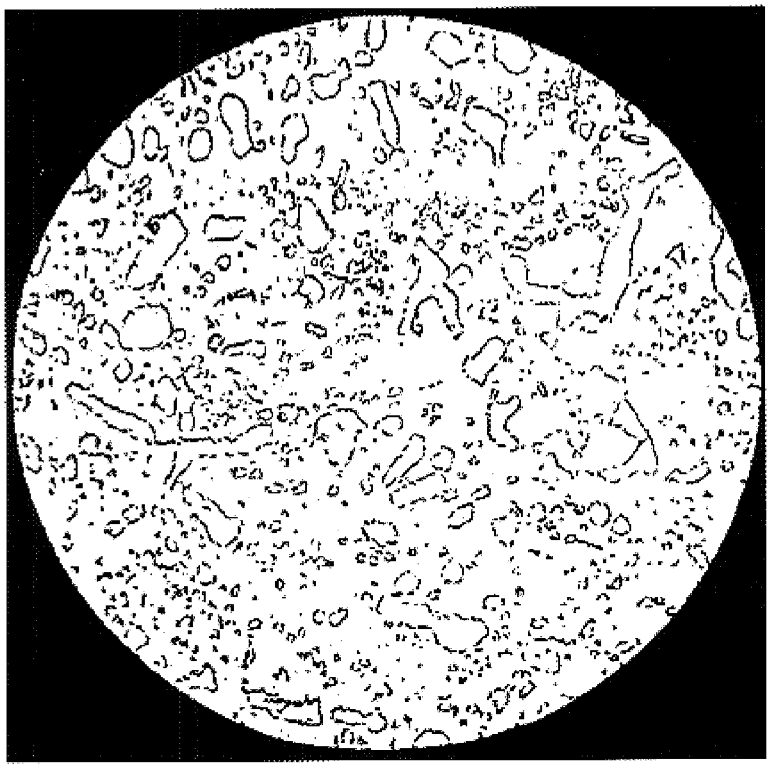
FIG. 6 is a photomicrograph (1000×) of the microstructure of an Indian blade from the Belaiew's collection, illustrating globules of spheroidized cementite imbedded in a sorbite matrix.

The tendency to form spherical particles in nickel-based alloys during heat-treatment can be demonstrated by formation of round, 0.2 $\mu$m $Ni_3Al$ ($\gamma$-prime)-precipitate particles in Ni-19%Cr-6%Al alloy, aged at 750° C. for 540 h. (Meyers, M. A., Mechanical Metallurgy, Principals and Applications, Prentice Hall, New Jersey, 1984, p. 412, FIG. 11.7) and by formation of carbide particles, about 0.3 $\mu$m size in Nimonic 75 aged at 850° C. for 16 h. (see Practical Electron Microscopy in Material Science, ed. Edington, J. W., Van Nostrand, New York 1976, p. 238, FIG. 4.23*b*).

Grain boundary strength is the point of fundamental value for superalloys, which are designed for continuous duty at temperatures about 1000° C. and higher. The aim of titanium additions is to provide stable carbides for inhibiting grain boundary sliding during creep.

The concentration of carbon in nickel-based superalloys is rather low, 0.08–0.18% (see Winstone, p. 30). The reason may be the same as in high-carbon steels, developed by standard techniques, namely formation of rough carbides mainly at the grain boundaries, which provoke crack generation.

The method of the invention with controlled cooling from the liquid state for developing small size carbide particles can be applied to nickel-based superalloys to provide an improvement of structure and working characteristics. Particularly, compositions of nickel-based alloys, constructed especially for developing by the proposed method, can include higher carbon concentrations (up to about 0.5 to about 0.8% and higher) for the formation of uniformly distributed microspherical carbides, preferably titanium or zirconium carbides. By the analogy to the Fe—C system, during the process of the controlled cooling from the melting point, small particles of carbides can be formed both at the grain boundaries and inside grains. Optimal compositions of modified nickel-based alloys can include elements such as Cr (oxidation resistance), Al (formation of gamma prime phase, based on $Ni_3Al$), Mo (increases the strength of matrix), B (due to its small atomic diameter can easily travel through the lattice and decrease the possibility of crack generation).

Titanium carbides possess the greatest hardness among other carbides hardness, 9.5 (Mohs scale), and the greatest stability at high temperature. Kosolapova T. Y., Carbides, Moscow, Metallurgia 1968 (Russian). Unfortunately, due to the their thermodynamic stability, titanium carbides can originate and grow in the liquid alloy. To avoid or at least to restrict this deleterious effect, the carbide can be added to the liquid alloy just before casting in the form of micropowders of less stable carbides, such as, for example, as carbides of nickel, cobalt, aluminum, iron, molybdenum, and vanadium. The effectiveness of introducing of carbon into titanium alloys by means of less stable carbides was described in U.S.

Pat. No. 5,141,574. Being deprived of their carbon component, metal atoms from the above mentioned carbides will enter the solid solution. Furthermore, the metals listed above enter the compositions of typical superalloys. Micropowders, added to the liquid alloy just before casting can also play another positive role, namely, by providing centers for crystallization, the micropowders will favor developing small grain size.

3. Ti—C System

Figure 11:
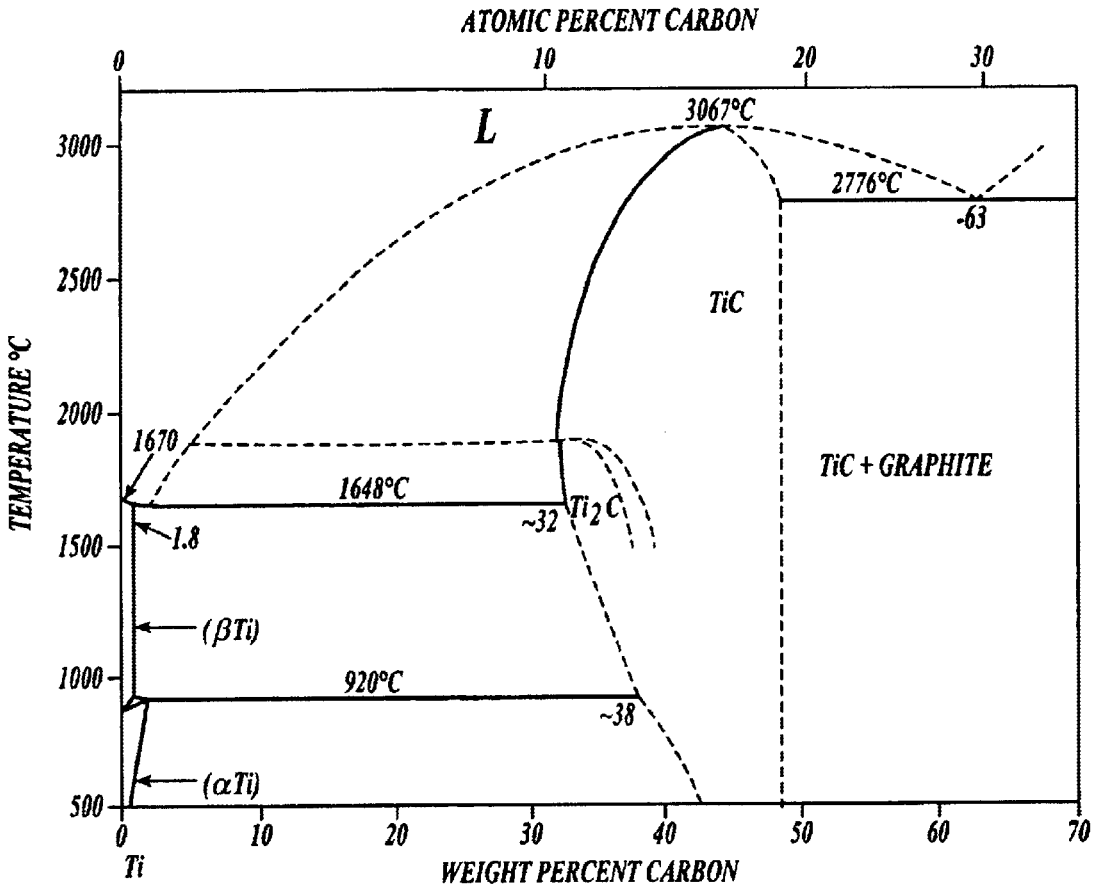
FIG. 11 is the phase diagram for the Ti—C system.

The method of the invention can produce strong and viscous titanium alloys with a structure characterized by the uniform distribution of small hard particles in softer matrix. The phase diagram of Ti—C system is shown at FIG. 11. See, Phase Diagrams of Binary Titanium Alloys, 1987. The precipitation of titanium carbide in this system must proceed during a very long temperature interval, from liquid (about 2200° C. for 8–12 atom percent carbon which would correspond to about 20–25 volume percent of titanium carbides) to solid at 1648° C. Because of the extremely high chemical activity of titanium at high temperatures, the thermal mechanical processing of the Sherby type in titanium alloys would be greatly complicated.

Firstly, to develop the small size carbide particles, the crystallization process of the Ti (5–20 atom percent carbon, preferably 8–12 atom percent carbon) can be performed in the controlled cooling regime with a fast enough beginning stage for developing a small grain size Ti matrix and non-rough spherical or thin platelet carbide particles followed by annealing at comparatively lower temperature interval, about 800–1000° C. for the coagulation of small size carbide particles.

Secondly, the carbon for formation of the strong titanium carbides in the microspherical form can be introduced into the liquid titanium before casting in the form of the mixture of less stable at high temperatures carbides of other elements, such as, for example, $Al_4C_3$, $Cr_3C_2$, $Mn_xC_y$, MoC, WC, $Fe_3C$, and VC. Micropowders of carbides are preferable for decreasing the grain size. The total concentration of carbon in a resulting alloy is preferable at the range 8–15 atom percent or higher, because some original carbides will be not fully dissolved in this process. Giving off their carbon atoms to Ti carbides, most of these elements will enter during high temperature into the solid solution. The effectiveness of introducing of C into titanium alloys by means of less stable carbides was described in U.S. Pat. No. 5,141,574.

The desired interrelation between strength and plasticity in Ti—C-based alloy can be varied by the addition of additives that stabilize either β-phase or α-phase or produce resulting (α+β) phase structure strengthened by the uniform distribution of predominantly microspherical carbides.

The method of the invention can be applied to other systems for developing an appropriate microstructure with small size precipitates for cast alloys in Zr—C, Zr—B systems, which are of significance for applications in nuclear reactors.

4. Alloys With Intermetallic Compounds

The method of the invention can be applied to alloys that include intermetallic compounds, such as, for example, dispersion hardened alloys, duralumin, Al 4% Cu alloy. (Meyers, M. A., Mechanical Metallurgy, Principals and Applications, Prentice Hall, New Jersey, 1984). Solubility of copper in the aluminum is failing with the decrease of temperature, which provides the precipitation of copper atoms in the form of an intermetallic compound $CuAl_2$. There are three extreme regimes of the heat treatment of duralumin: (1) slow cooling from the melting point results in a structure having large particles of $CuAl_2$ in an Al matrix and the material is very soft; (2) quenched state provides a supersaturated solid solution of Cu atoms in Al matrix, and the material is soft; and (3) optimal regime of aging at room temperature or above produces a strong material with a structure having fine scale precipitates.

A difference between the optimal conditions for producing precipitates in duralumin and in the present method for high-carbon steel relates to the initial state (i.e., high temperature but in solid state in duralumin and the liquid state in Fe—C alloy).

Intermetallic compounds are characterized by strong chemical interaction between atoms and form usually hardening phases in alloys. The following are representative examples of such intermetallic compounds.

a. Al Alloys

Representative aluminum alloys include the following.

Precipitation of rounded particles $Mg_2Si$ in Al 6061 both in grain boundaries and grain interiors (Meyers, M. A. Mechanical Metallurgy, Principals and Applications, Prentice Hall, New Jersey, 1984, p. 403, FIG. 11.1*a*). Large dimension grain size (50 μm) and particles (up to 5 μm) indicate on a good perspective for further improvements.

Figure 3:
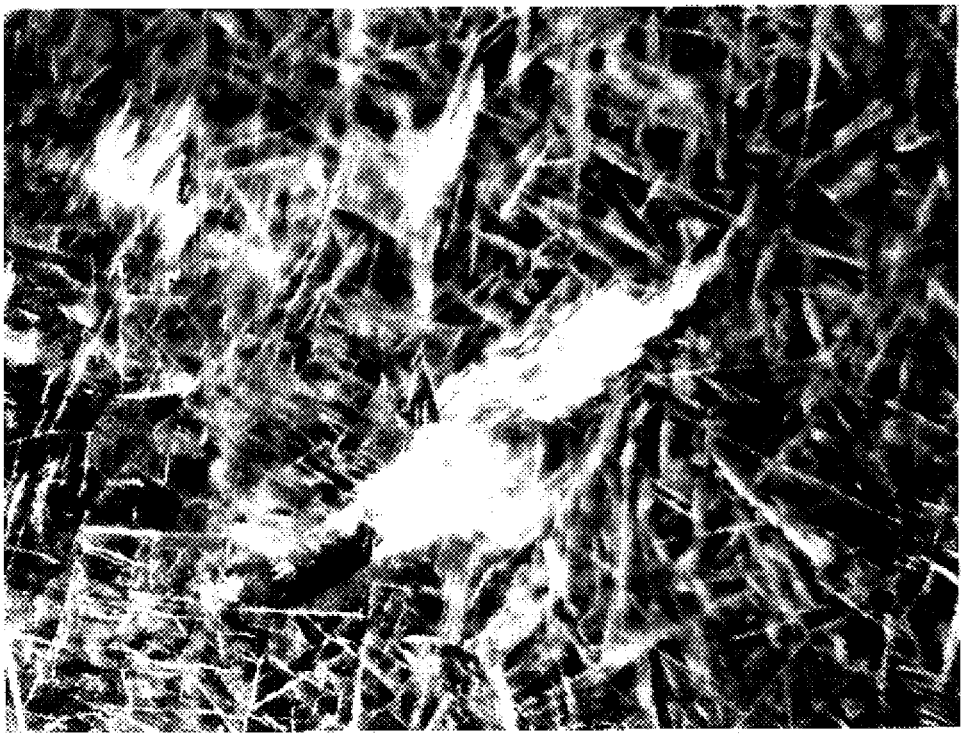
FIG. 3 is a photomicrograph (500×) of the microstructure of a steel with 1.8% C, 0.20% Cu and 0.19% Si after quenching from the liquid state, illustrating rough cementite plates.

Precipitation of spherical submicron size particle of $Al_3Li$ (δ') phase particles was observed during annealing of Al 2.7% Li alloy at 200° C. Su, D.L., Effect of Prior Cold Deformation on Aging Behavior of Al-2.7% Li Alloy in Strength of Metals and Alloys, ed. Kettunen, P. O., Vol. 2, Permagon Press (1989), p.593, FIG. 3.

Precipitates $Al_3Zr$, $Co_2Al_9$, $Al_2Mg_2Cr$, $MnAl_6$ in airframe aluminum alloys of 7000 series as been reported. Kolkman, H. J., Quench Sensitivity of Airframe Aluminum Alloys in Strength of Metals and Alloys, ed. Kettunen, P. O., Vol. 2, Permagon Press (1989).

b. Co—Ti Alloys

Representative cobalt-titanium alloys include the following.

A homogeneous distribution of coherent $Co_3Ti$ precipitates of a submicron size was shown by an electron microscopic study of Co-6% Ti alloy quenched from 875° C. Practical Electron Microscopy in Material Science, ed. Edington, J. W., Van Nostrand, New York (1976), p. $23^6$, FIG. 4.21.

Casting and heat-treating of alloys, which are apt to the formation of intermetallic compounds, according to the method of the invention provides an effective and low-cost method for development of alloys with essentially improved characteristics.

As noted above, methods for forming high-carbon steel with grain cementite structure include: (1) annealing of grain pearlite, which provides large size cementite inclusions, and is characterized as having high plasticity, but low strength; and (2) the Sherby method, which provides steels with unique strength parameters, but the method is restricted to forming plate material, and requires long processing times and the need of special equipment. In contrast, the method of the present invention is a simple, inexpensive cast method. The method provides steels having greater strength than ordinary cast steels, and also provides steels having greater plasticity.

In accordance with the present invention, articles from high-carbon steels might be developed in a high-strength and plastic condition with the structure, characterized by a small-size spherical cementite particles and small grain size, by means of casting without intensive mechanical treatment, what is the principal feature of the method for producing the Damascus steel and the method of Sherby.

The following examples are intended to illustrate the application of the present invention to the preparation of cast strong and plastic alloys, and are not intended to limit the scope of the invention.

EXAMPLES

Example 1

In this example, the influence of the cooling rate from the initial state (temperature 1120–1140° C., 1 hour) on the structure of carbide phases (diameter of samples 10 mm) is demonstrated.

Cooling with a furnace provides a matrix from ferrite and low-carbon pearlite grains with large (about 20 $\mu$m) graphite particles as shown in FIG. 13A.

Cooling in air to 700–750° C. and 1 hour annealing provides chains of rough rounded cementite particles at the grain boundaries and low-carbon pearlite structure inside grains as shown in FIG. 13C.

Example 2

In this example, the influence of the initial temperature of the brick form on the microstructure of cast high-carbon steel with 1.8%C is demonstrated.

Figure 7:
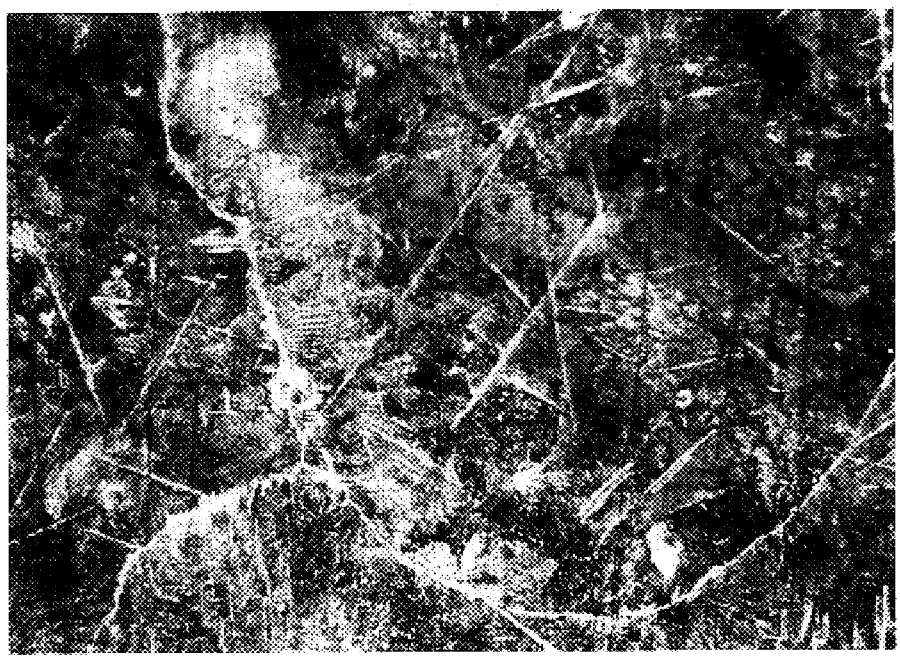
FIG. 7 is a photomicrograph (500×) of the microstructure of a representative steel formed in accordance with the present invention having 1.8% C, 0.20% Cu and 0.5% Si; casting into a preheated to 650° C. sand form and slowly cooling, illustrating thin cementite layers at the grain boundaries and partly spheroidized pearlite inside grains.

With an initial temperature of 20° C. and a metal plate having a 3 mm thickness, the resulting microstructure has a uniform distribution of 20–40 $\mu$m-long cementite platelets as shown in FIG. 13B;

With an initial temperature of about 650° C. and a metal plate having a 3 mm thickness, the resulting microstructure has broken thin cementite layers at the grain boundaries and partly spheroidized pearlite inside grains as shown in FIG. 7.

Example 3

Figure 9:
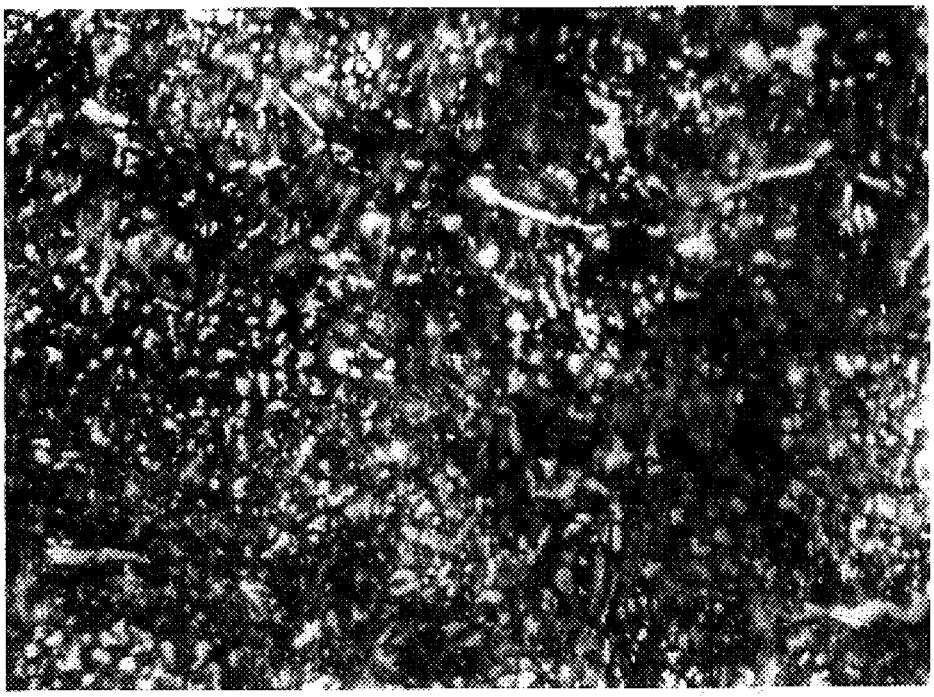
FIG. 9 is a photomicrograph (1000×) of the microstructure of a representative steel formed in accordance with the present invention having 1.8% C, 0.20% Cu and 0.19% Si cast into the massive copper and annealed 6 h at 750° C.

Developing a cast high-carbon steel with 1.8%C with the structure of small size spherical cementite particles by means of casting into a massive copper form with the subsequent annealing at 750° C. for 6 hours provides a microstructure as shown in FIG. 9.

Example 4

Figure 10:
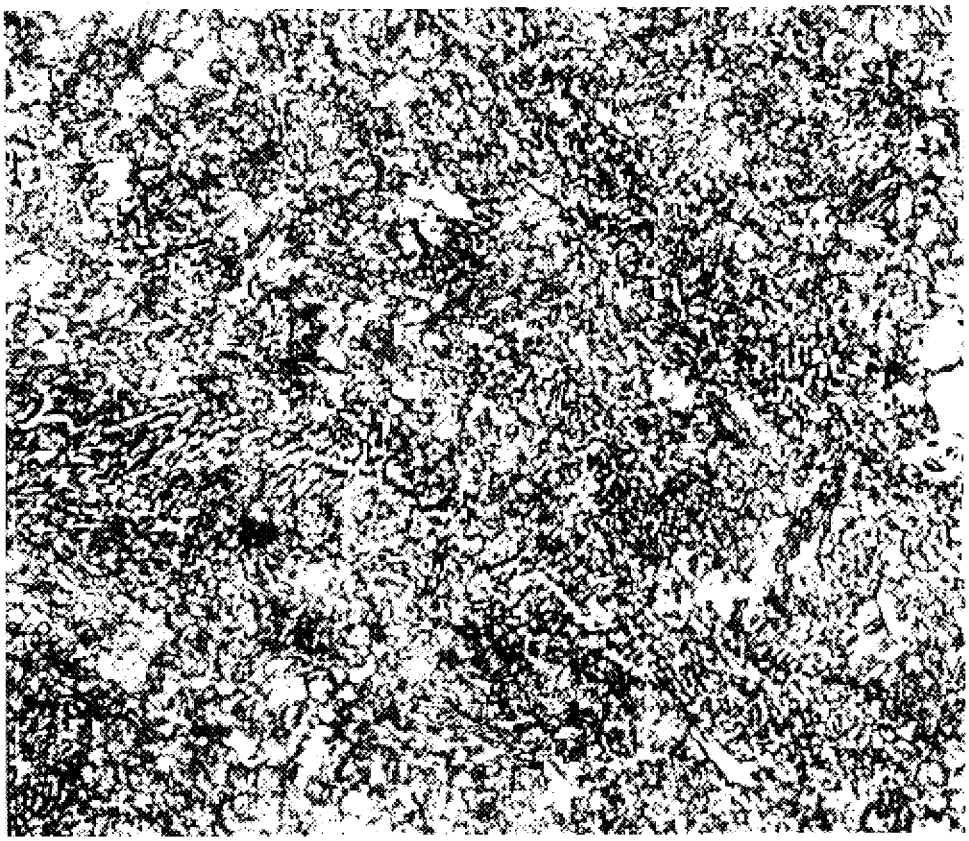
FIG. 10 is a photomicrograph (500×) of the microstructure of a representative steel formed in accordance with the present invention having 1.8% C, 0.20% Cu and 0.19% Si cast into the preheated to 700° C. sand form and annealed 6 h at 750° C.

Developing a cast high-carbon steel with 1.8%C with the structure of small size spherical cementite particles by means of casting into the preheated to 700° C. sand form an annealing at 750° C. for 6 hours provides a microstructure as shown in FIG. 10.

Example 5

Figure 8:
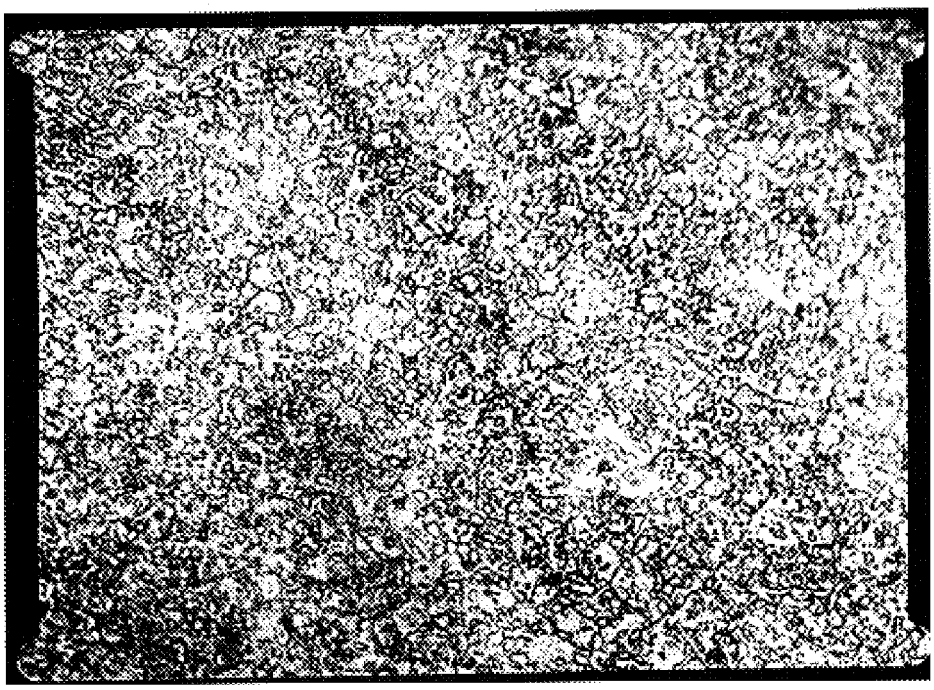
FIG. 8 is a photomicrograph (500×) of the microstructure of a cast steel with 1.5% C and 0.20% Cu (archeological sample, Cast celt from Pol'tze, V cent. B.C.)

Small grain cementite structure was found in our metallographic analysis of different archeological items from Pol'tze, a settlement at Amur river, V–IV century B.C. Some of these samples were hammered but several samples were received by casting, namely cast celts, inventory numbers 78, 97 and 99 at the collection of the Novosibirsk Institute of Archeology and Ethnography of Siberian Division of Russian Academy of Sciences (see FIG. 8). Details of technology, which was used by the capable metallurgists from Pol'ze is not known.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for forming high-carbon steel having from about 8 to about 2.3 percent by weight carbon, comprising:

(a) casting a high-carbon steel into a form to provide cast high-carbon steel; and (b) immediately cooling the cast high-carbon steel at a rate to provide a steel having grain cementite particles with a diameter in the range from about 0.1 to about 5.0 $\mu$m;

wherein the cooling rate is greater than the rate resulting in the formation of graphite globules, wherein the cooling rate is less than the rate resulting in the formation of cementite platelets, and wherein the steel having grain cementite particles is produced without thermomechanical treatment.

2. The method of claim 1, wherein the high-carbon steel has an ultimate strength from about 120 to about 250 kg/mm$^2$.

3. The method of claim 1, wherein the high-carbon steel has a plasticity of about 10%.

4. The method of claim 1 wherein the cast high-carbon steel further comprises a carbide-forming additive.

5. The method of claim 4 wherein the additive is at least one of chromium, molybdenum, titanium, zirconium, tungsten, and vanadium carbides.

6. The method of claim 1 wherein the cast high-carbon steel further comprises an alloy additive for stabilizing grain cementite.

7. The method of claim 1 wherein the cast high-carbon steel further comprises an alloy additive for decreasing matrix grain size.

8. The method of claim 1 wherein the steel comprises from about 10 to about 60 volume percent grain cementite.

9. The method of claim 1 wherein the steel comprises from about 20 to about 40 volume percent grain cementite.

10. A method for forming a structure with small-grain hardening particles in a dispersion-hardened alloy, comprising:

(a) casting a liquid alloy into a form to provide cast metal; and (b) immediately cooling the cast metal at a rate to provide a product having dispersion-hardened particles with a diameter in the range from about 0.1 to about 5.0 $\mu$m, wherein the cooling rate is greater than the rate resulting in the formation of a separated thermodynamic stable phase, and wherein the cooling rate is less than the rate resulting in the formation of platelets comprising the alloy elements.

11. The method of claim 10 wherein the dispersion-hardened particles comprise at least one of carbides, borides, nitrides, oxides, and intermetallic particles.

12. The method of claim 10 wherein the cast metal further comprises an alloy additive for stabilizing the dispersion-hardened particles.

13. A method for forming an alloy, comprising:

(a) casting a liquid alloy into a form to provide cast metal, the alloy comprising a first element and a second element, wherein the second element has a decreasing solubility in the first element with decreasing temperature; and (b) immediately cooling the cast metal at a rate to provide a product having particles substantially uniformly dispersed throughout the alloy, wherein the particles comprise first and second elements, and wherein the particle diameter is in the range from about 0.1 to about 5.0 $\mu$m, wherein the cooling rate is greater than the rate resulting in the formation of thermodynamic stable phase of the second element, and wherein the cooling rate is less than the rate resulting in the formation of platelets comprising the first and second elements.

14. The method of claim 13, wherein the first element comprises at least one of nickel, titanium, zirconium, aluminum, copper, and cobalt.

15. The method of claim 13, wherein the second element is at least one of boron, carbon, nitrogen, oxygen, and elements forming intermetallic compositions.

16. The method of claim 13 wherein the second element comprises a plurality of elements.

* * * * *